US007152734B2

(12) United States Patent
Chen

(10) Patent No.: US 7,152,734 B2
(45) Date of Patent: Dec. 26, 2006

(54) SEALED PACKING BOX WITH A SIZE CHECKING SPACE

(76) Inventor: Tsan-Nien Chen, 5 Fl., No. 115, Sec. 2, Huanhe N. Rd., Datong District, Taipei (TW)

( * ) Notice: Subject to any disclaimer, the term of this patent is extended or adjusted under 35 U.S.C. 154(b) by 183 days.

(21) Appl. No.: 10/890,117

(22) Filed: Jul. 14, 2004

(65) Prior Publication Data

US 2006/0011505 A1 Jan. 19, 2006

(51) Int. Cl.
*B65D 85/00* (2006.01)
*B65D 73/00* (2006.01)

(52) U.S. Cl. ..... 206/320; 206/349; 206/461

(58) Field of Classification Search ..... 206/461–471, 206/349–379, 733–734, 318, 320, 488; 33/199 R, 33/549, 555.2, 555.1, 551, 679.1
See application file for complete search history.

(56) References Cited

U.S. PATENT DOCUMENTS 2,896,333 A * 7/1959 Kivela ..... 33/555.2
3,230,628 A * 1/1966 Hite ..... 33/199 R
3,703,234 A * 11/1972 Howard ..... 206/349
4,815,610 A * 3/1989 Borick et al. ..... 206/459.5
5,562,208 A * 10/1996 Hasler et al. ..... 206/373
5,755,323 A * 5/1998 Zahn et al. ..... 206/470
6,082,538 A * 7/2000 Snider et al. ..... 206/372

FOREIGN PATENT DOCUMENTS

EP 0727363 A1 * 8/1996 ..... 206/471

* cited by examiner

*Primary Examiner*—Bryon P. Gehman
(74) *Attorney, Agent, or Firm*—Troxell Law Office PLLC

(57) ABSTRACT

A sealed packing box having a size checking space comprises a front portion and a rear portion abutting against and connecting with each other, the front portion is a transparent plastic housing, and the rear portion is a sheet member capable of abutting against and connecting with the front portion; the sealed packing box after being assembled has a first receiving space to completely seal a product packed, and a second receiving space as a size checking space to check whether a product packed is compatible with what one needs, the second receiving space has an access communicating with the outside. Thereby, a consumer can put an article in the second receiving space to check whether the volume of the product packed meets what he wants.

4 Claims, 7 Drawing Sheets

SEALED PACKING BOX WITH A SIZE CHECKING SPACE

BACKGROUND OF THE INVENTION

1. Field of the Invention

The present invention is related to a sealed packing box suiting various articles, and especially to a sealed packing box with a receiving space and a size checking space with the same volume as a product packed, a consumer can make checking with a real article in purchasing a product. This is convenient for making a trial to assure the product meets what one needs to reduce dispute in trading.

2. Description of the Prior Art

Exquisite packages not only can attract consumers to purchase, but also can provide more perfect protection for the content packed; a product being suitably packed can more largely increase the entire feeling of value of the product. In the industrial and commercial society of today, the consciousness of consumers has been increased, competition is vigorous and pace is fast, therefore good packages for products never can be neglected.

Some manufacturers add plastic packages over products during delivery of the products, and use stapling machines or some other sealing equipment to pack and seal. Such a mode of packing can be convenient for dismantling for use of consumers, it is not quite satisfactory in protecting products though. Because such mode of packing is too simple and plain to make products outstanding, this in turn is unable to arouse the desire of purchasing of consumers.

Therefore, some manufacturers adopt more advanced vacuum packing which packs products each in a receiving space formed from a transparent case and a back plate. So that on one hand, consumers can see the products through the transparent case, and on the other hand, the information about the products can be disclosed on the back plate for the convenience of comprehension and choosing.

Such mode of packing provides good protection for products, and avoids damage of the products by dismantling by consumers for trial; generally, such mode of packing adopts sealing type packing. The packing of such mode surely provides perfect protection and surely elevates the feeling of value of the products, and it is more convenient for displaying the products on hung shelves; however, it renders more inconvenience and uncertainty of consumers' purchasing.

For example, products concerning volumes such as cases for cell phones etc. are classified by size, it is difficult to accurately make sure of their sizes unless a consumer has had such a product already; and or may be the back side of a package has detailed specification about such products of various types, the consumer can thereby surely know about the product. Otherwise, the consumer is completely unable to be sure about the product he wants to buy, and unable to be sure about whether the product can satisfy his expected requirements; especially in the case of cell phones being products in fashion, manufacturers change the types of them very frequently, sizes of them are not identical actually, once the products bought do not meet what the consumer wants, returning or changing shall be done at the same store, this is not only very inconvenient, but also subjected to making disputes of trading.

SUMMARY OF THE INVENTION

In view of the above stated, and for finding a novel mode of packing for a sealed box, the inventor of the present invention provides a sealed packing box suiting various articles, having a size checking space with the same volume as the product packed to be convenient for making sure a product meets what one needs in purchasing and thus help reducing dispute in trading, and provides the sealed packing box based on his professional experience of years and after nonstop designing and improvement.

The primary object of the present invention is to provide a sealed packing box suiting various articles; the packing box has a receiving space and a size checking space with the same volume as a product packed.

To get achieve the above object, a sealed packing box having a size checking space of the present invention comprises a front portion and a rear portion abutting against and connecting with each other, the front portion is a transparent plastic housing, and the rear portion is a sheet member capable of abutting against and connecting with the front portion; the sealed packing box after being assembled has a first receiving space to completely seal a product packed, and a second receiving space as a size checking space to check whether a product packed is compatible with what one needs, the second receiving space has an access communicating with the outside. Thereby, a consumer can put an article in the second receiving space to check whether the volume of the product packed meets what he wants.

The present invention will be apparent after reading the detailed description of the preferred embodiment thereof in reference to the accompanying drawings.

DETAILED DESCRIPTION OF THE PREFERRED EMBODIMENT

Figure 1:
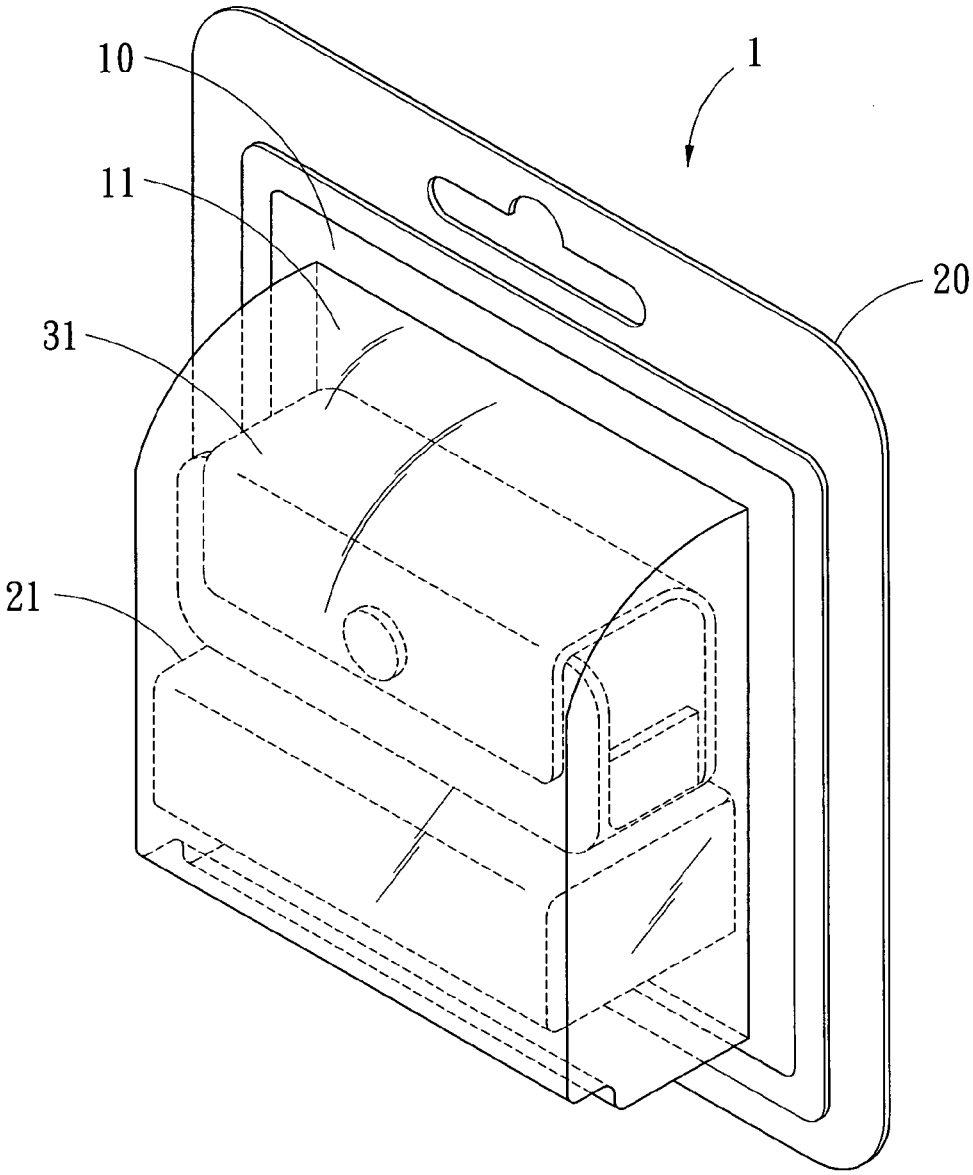
FIG. 1 is a perspective front view of an embodiment of the present invention.

Referring to FIG. 1 depicting a first embodiment of a sealed packing box 1 having a size checking space of the present invention, the packing box 1 comprises a front portion 10 and a rear portion 20 abutting against and connecting with each other, the front portion 10 is a transparent plastic housing, and the rear portion 20 is a sheet member capable of abutting against and connecting with the front portion 10, the assembled sealed packing box 1 has a first receiving space 11 to completely seal a product packed, and a second receiving space 21 to check the identity by volume of the product packed, the second receiving space 21 has an access 22 communicating with the outside.

Figure 2:
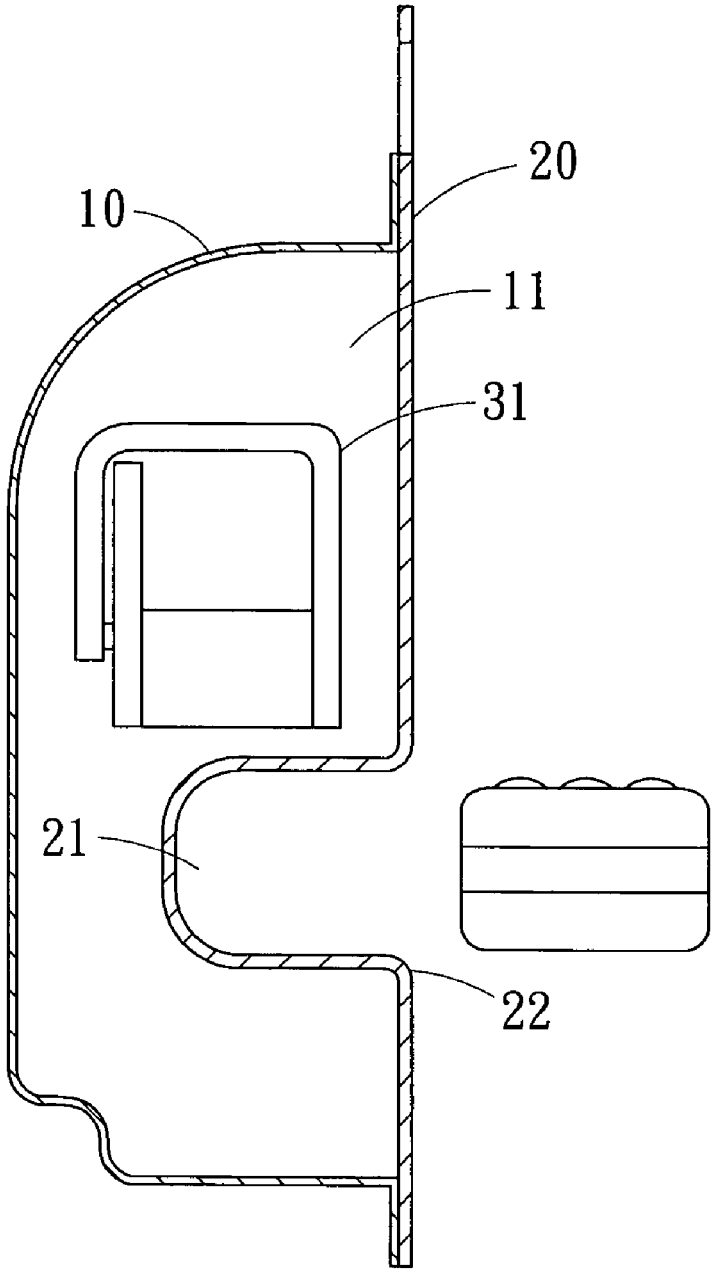
FIG. 2 is a sectional side view of the embodiment of the present invention.

As shown in FIGS. 1 and 2, when in application, a leather case 31 of a cell phone is packed in the first receiving space 11. A consumer can see the leather case 31 through the front portion 10 for choosing an item suitable for him. In order to assure that the item chosen meets what he wants, the consumer can place his own cell phone in the second receiving space 21 on the rear portion 20 of the packing box 1 from the access 22. When the cell phone is compatible with the second receiving space 21, it means that the leather case 31 for choosing can satisfy the requirement of the consumer.

Figure 3:
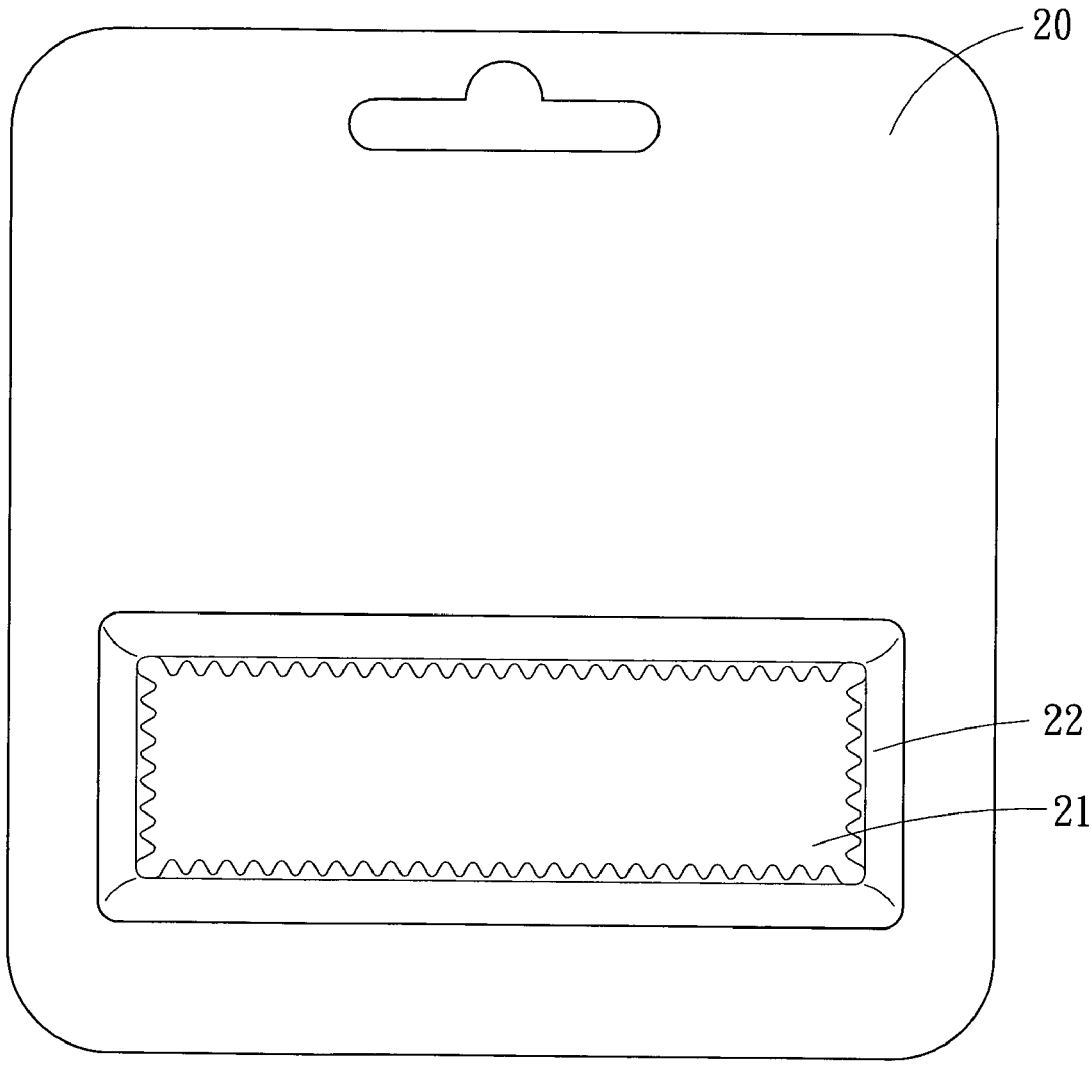
FIG. 3 is a back view of the embodiment of the present invention.
Figure 4:
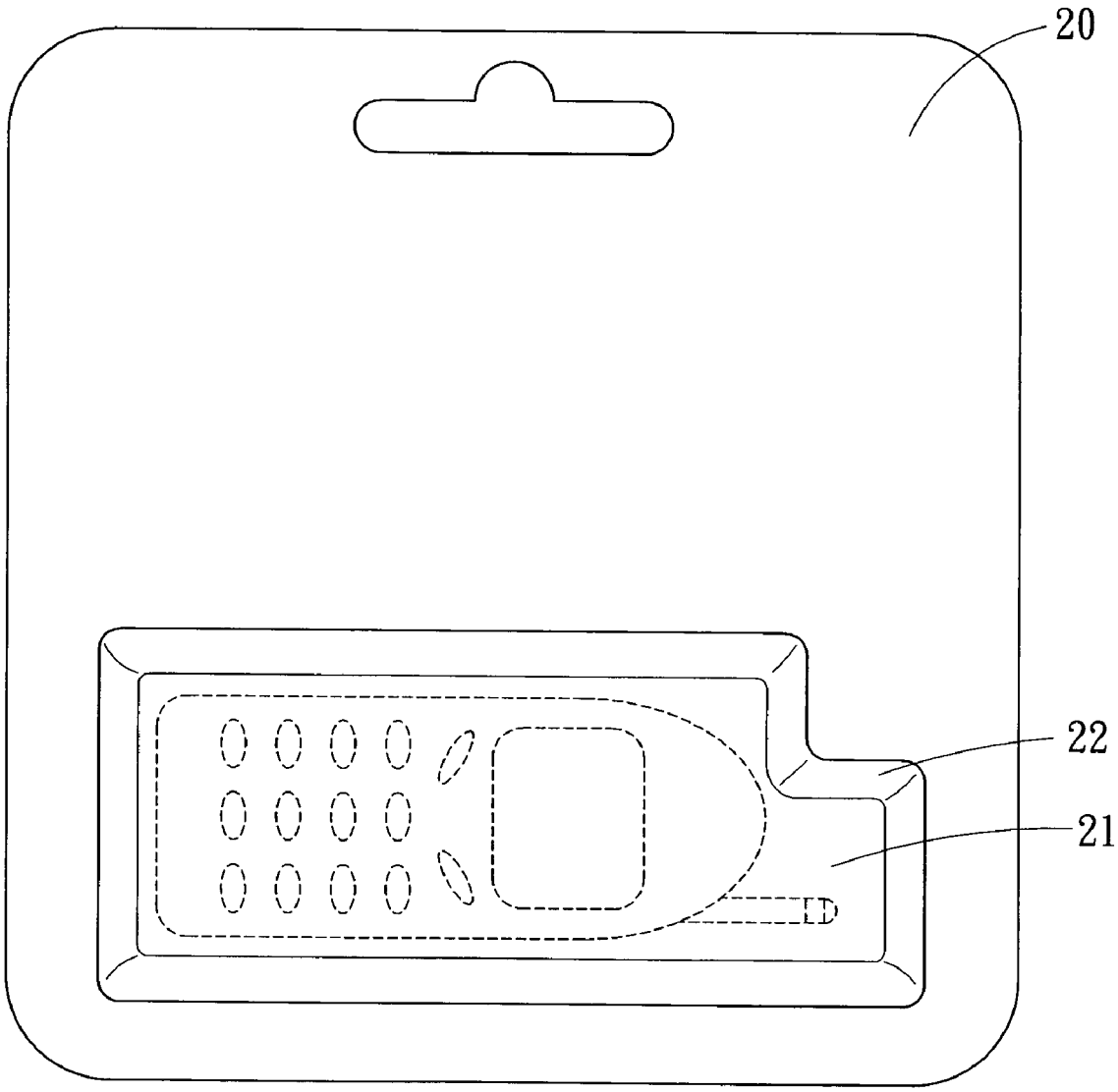
FIG. 4 is a schematic view showing use of the embodiment of the present invention.

As shown in FIG. 3, in practicing the present invention, it can be provided on a periphery 211 of the second receiving space 21 with an undulated rim slightly stretched out to simulate elasticity of the leather case 31. The periphery 211 represents the real scope of accommodation for the cell phone, so that the consumer can feel the periphery 211 as a leather case 31 that suits the cell phone when he places the cell phone in the second receiving space 21, no matter the space 21 exactly fits the cell phone or the periphery 211 is crowded to slightly expand. In this way, such as is shown in FIG. 4, the consumer can be aware of whether the leather case 31 suits the cell phone.

Figure 5:
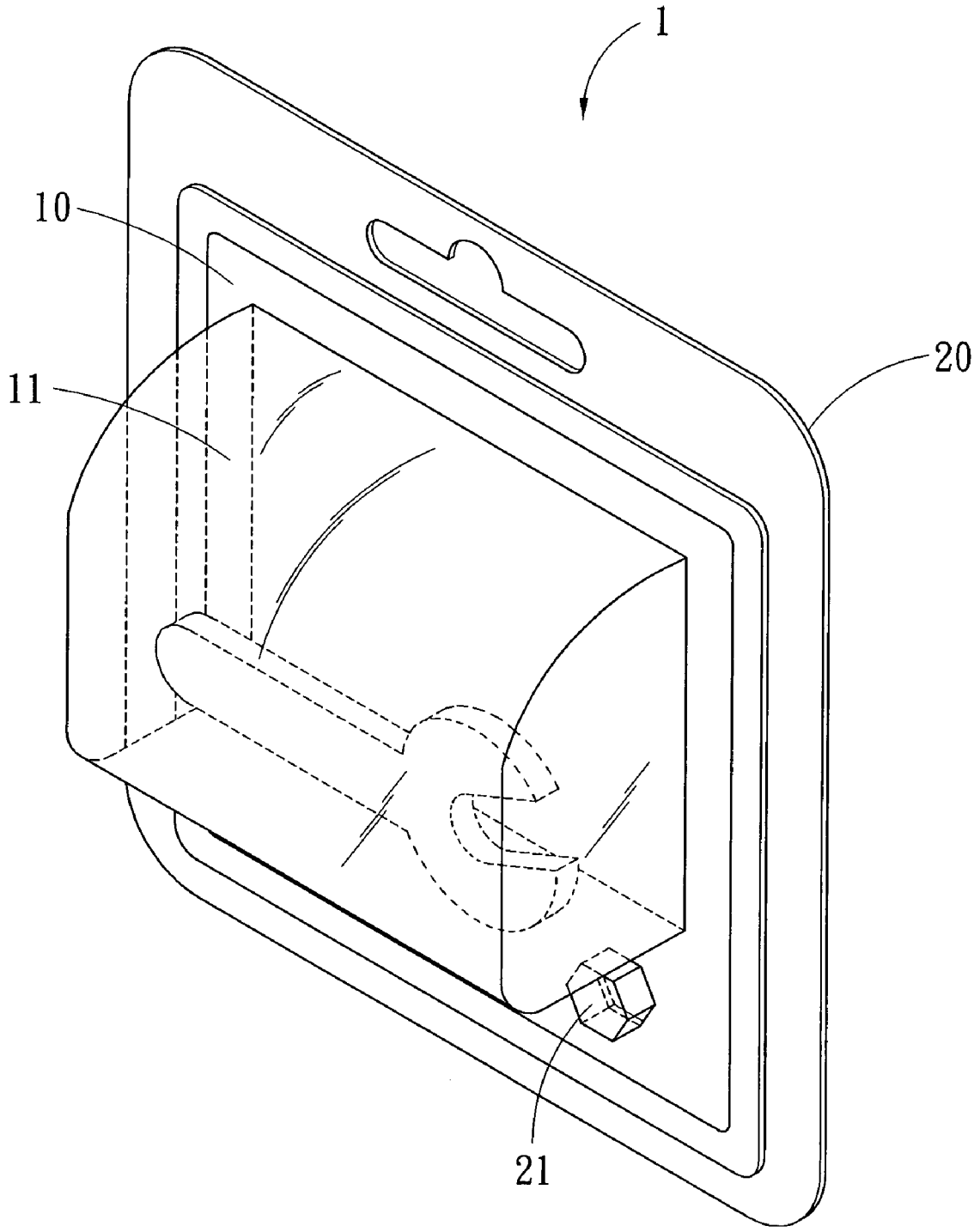
FIG. 5 is a perspective front view of another embodiment of the present invention.
Figure 6:
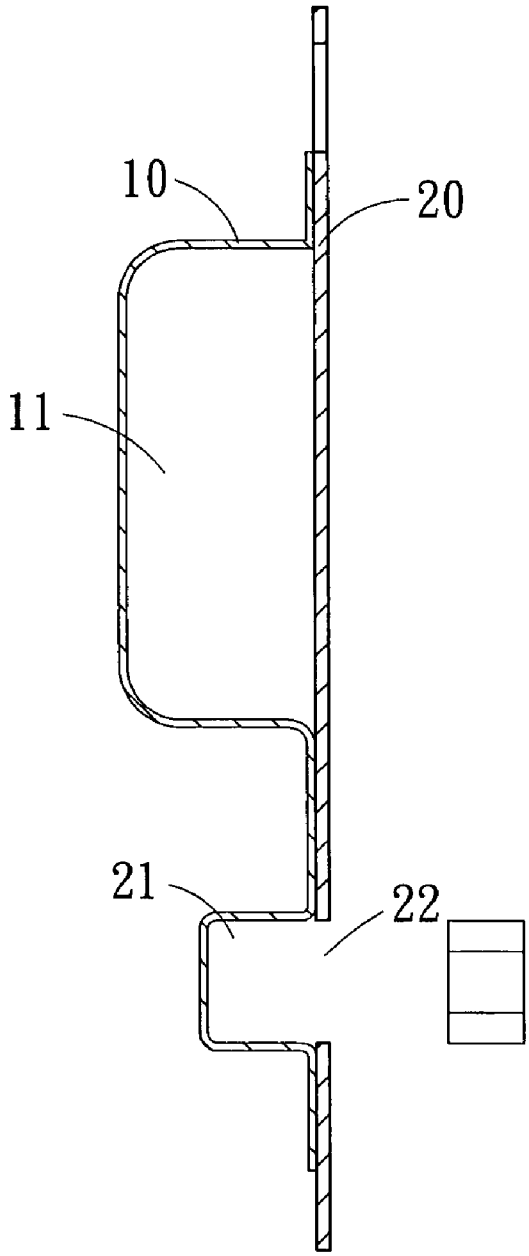
FIG. 6 is a sectional side view of the other embodiment of the present invention.
Figure 7:
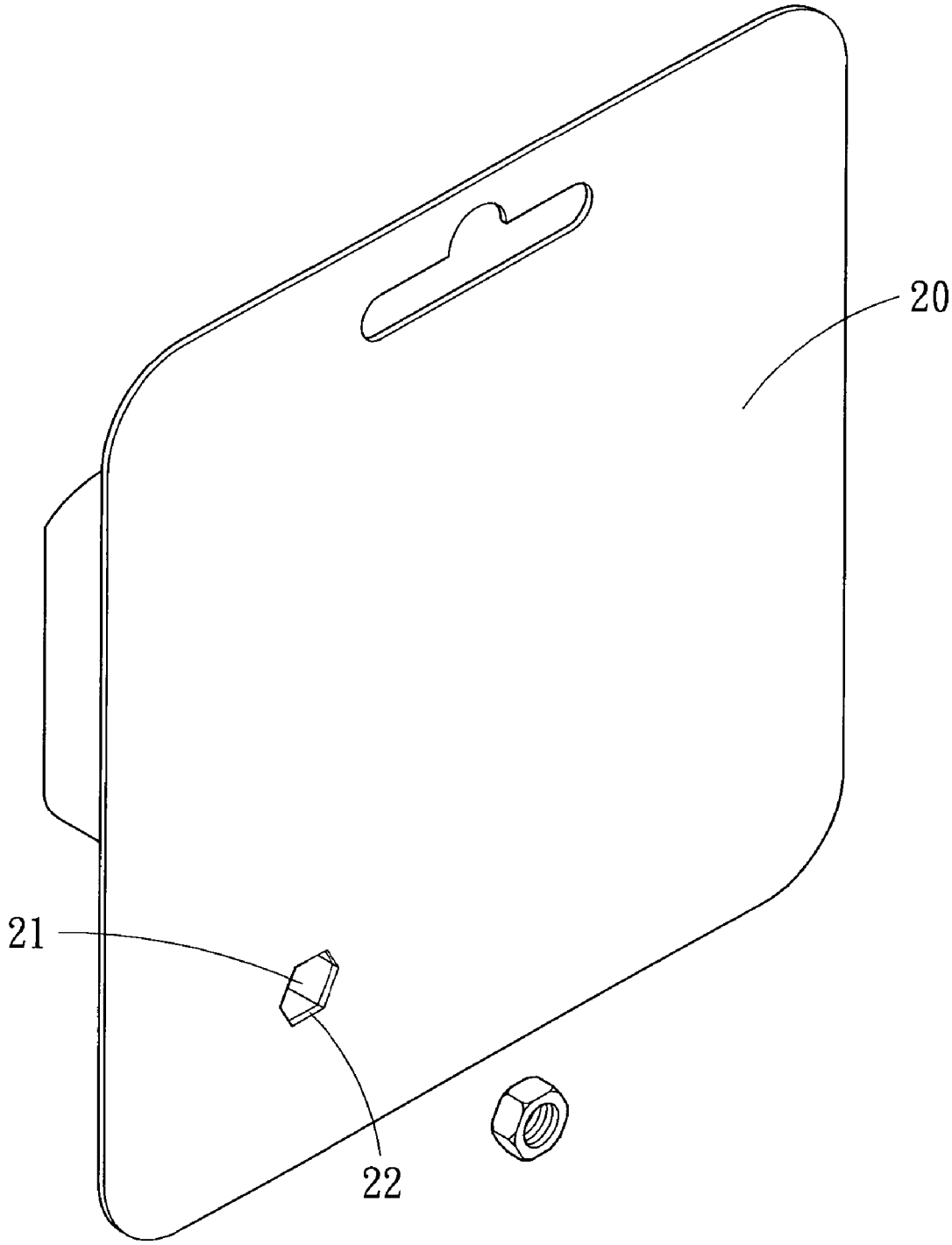
FIG. 7 is a schematic perspective view showing use of the other embodiment of the present invention.

FIGS. 5 and 6 show another embodiment of the present invention, wherein the packing box 1 similarly comprises a front portion 10 and a rear portion 20. When in application, the embodiment can be used for packing various hand tools, for example: a wrench 33 is packed in the first receiving space 11, the second receiving space 21 can be of a size same as that of a nut 32 suiting the wrench 33. Thereby a consumer can see the wrench 33 through the front portion 10 for choosing the item suitable for him. The nut brought by the consumer can be placed in the second receiving space 21 on the rear portion 20 of the packing box 1. When the nut is compatible with the second receiving space 21, this means that the size of the wrench 33 chosen satisfies what the consumer wants, such as is shown in FIG. 7.

Thereby, the sealed packing box having a size checking space has the following advantages:

1. The sealed packing box having a size checking space of the present invention is structurally simple, and has the second receiving space with a shape and a volume identical to those of product packed; it can be convenient for measuring and comparing by a consumer, and disputes in trading can be reduced, hence it provides convenience in utilizing.
2. The sealed packing box having a size checking space of the present invention is similar in its equipment of production to that of the conventional sealed packing box, it needs no large amount of changing, and needs no increasing cost of equipment; thereby it has a high economic value.
3. The sealed packing box having a size checking space of the present invention is suitable for packing one of various products for electronic information, parts of mechanical hardware or hand tools etc., its scope of utilization is very wide.

In conclusion, the present invention surely can get the expected object thereof to provide a sealed packing box having a size checking space with the same volume as a product packed; it is convenient for making sure a product meets what one needs in purchasing to reduce dispute in trading, and suits various articles. The present invention thereby has a high industrial value.

What I claim as new and desire to be secured by Letters Patent of the United States are:

1. A sealed packing box with a size checking space, said sealed packing box comprises a front portion and a rear portion abutting against and connecting with each other, said front portion is a transparent plastic housing, and said rear portion is a sheet member; said sealed packing box after being assembled has a first receiving space to completely seal a product packed, and a second receiving space as said size checking space to check whether said product packed is compatible with what a consumer needs, said second receiving space has an access communicating with an exterior of the sealed packing box;

thereby, the consumer is allowed to put an article in said second receiving space to check whether the volume of said product packed meets requirements of the consumer, wherein said product packed is a leather case for a device selected from a group consisting of a cell phone and a product for information, said second receiving space of said sealed packing box has a protruding portion for placing an antenna of the device.

2. The sealed packing box with a size checking space as in claim 1, wherein said second receiving space protrudes frontwards into said first receiving space.

3. The sealed packing box with a size checking space as in claim 1, wherein: the contour of said second receiving space is coincident with said product packed in length and width, the periphery of said second receiving space is provided with an undulated rim.

4. The sealed packing box with a size checking space as in claim 1, wherein: said access of said second receiving space has guiding corners for the convenience of a user to place in an article for checking.

* * * * *